US006006778A

United States Patent [19]

Kim

[11] Patent Number: 6,006,778

[45] Date of Patent: Dec. 28, 1999

[54] DEVICE FOR SENSING THE AMOUNT OF OIL IN OIL PANS

[75] Inventor: Gyu Wan Kim, Seoul, Rep. of Korea

[73] Assignee: Hyundai Motor Company, Seoul, Rep. of Korea

[21] Appl. No.: 08/947,878

[22] Filed: Oct. 9, 1997

[30] Foreign Application Priority Data

Oct. 10, 1996 [KR] Rep. of Korea ..... 96-33401

[51] Int. Cl.[6] ..... F01L 3/08; F16C 33/76; F16J 15/32; F16J 15/56

[52] U.S. Cl. ..... 137/242; 123/90.37; 123/188.6; 123/188.9; 251/214; 251/263; 277/502; 384/16; 384/484

[58] Field of Search ..... 123/188.6, 188.9, 123/90.37; 251/214, 251, 266; 277/502, 550, 908, 909; 384/16, 484; 137/242

[56] References Cited

U.S. PATENT DOCUMENTS

| | | | |
|---|---|---|---|
| 1,954,643 | 4/1934 | Neuhaus | 251/266 |
| 3,409,337 | 11/1968 | Foote, Jr. | 384/484 |
| 3,442,517 | 5/1969 | Skinner | 123/188.6 |
| 3,447,848 | 6/1969 | Pitner | 384/484 |
| 4,356,997 | 11/1982 | Beffano | 251/266 |
| 4,611,931 | 9/1986 | Brandenstein et al. | 384/484 |
| 4,706,967 | 11/1987 | Ochsner | 277/502 |
| 4,763,618 | 8/1988 | Stritzke | 123/188.6 |
| 4,811,704 | 3/1989 | Boehmer et al. | 123/188.6 |
| 4,811,960 | 3/1989 | Stritzke et al. | 123/188.6 |
| 4,834,037 | 5/1989 | Lafever | 123/188.6 |
| 5,370,404 | 12/1994 | Klein | 384/484 |
| 5,387,040 | 2/1995 | Firestone et al. | 384/484 |

*Primary Examiner*—George L. Walton
*Attorney, Agent, or Firm*—Birch, Stewart, Kolasch & Birch, LLP

[57] ABSTRACT

A valve stem sealing device used for preventing oil from entering a combustion chamber through a gap formed between a valve guide and a valve stem is disclosed. The valve stem sealing device comprises an annular oil seal surrounding a valve stem and an annular support member fixed to the top of the valve guide so as to hold the oil seal in its place, wherein the support member has an inwardly opening annular recess and rotatably receives the oil seal in the recess, with a bearing being positioned between said oil seal and the side wall of the support member. In addition, a rubber member is tightly interposed between the support member and the valve guide so as to absorb the vibrations caused by a valve operation. Also, a support cap covers the outside wall of the oil seal so that the outside wall of the support cap is brought into contact with the bearing.

8 Claims, 2 Drawing Sheets

【FIG.1】
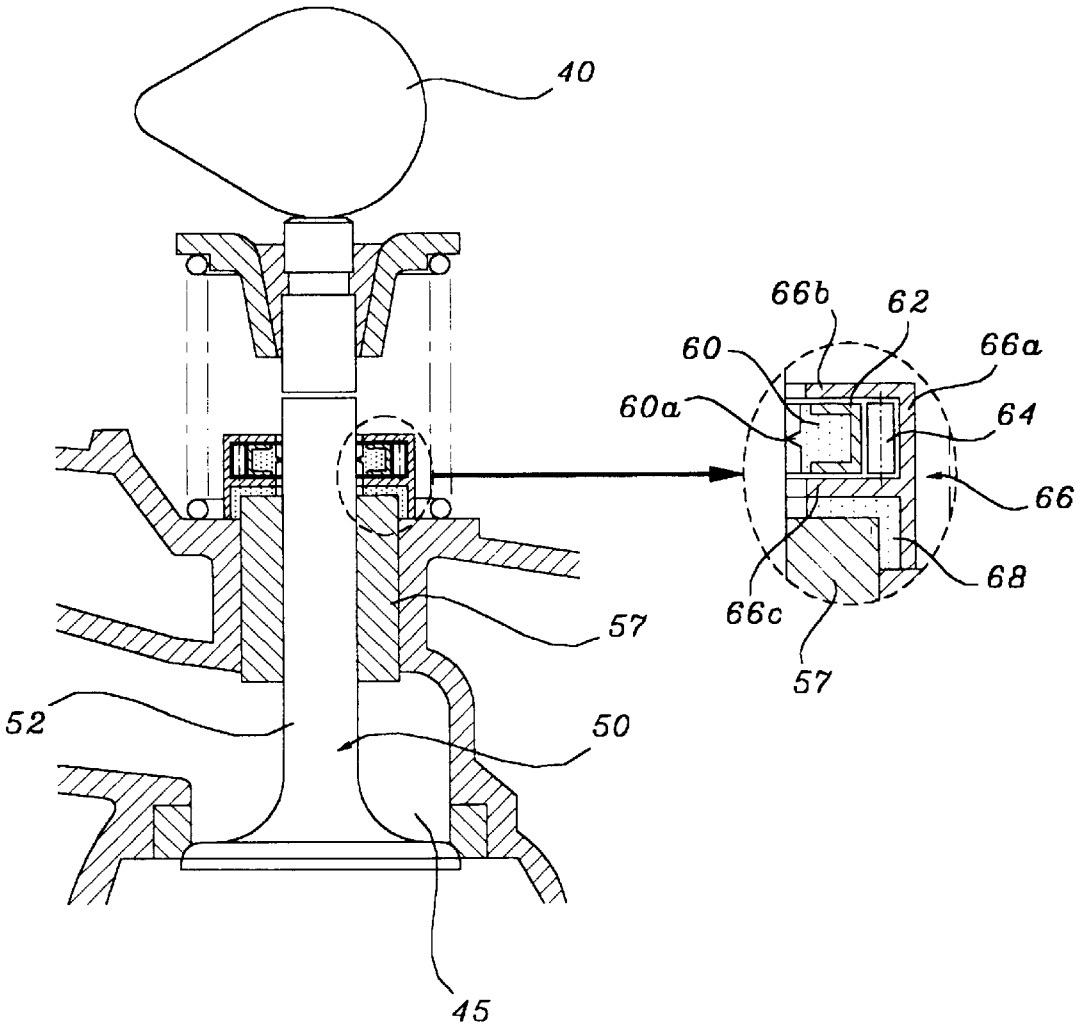

【FIG.2 (Prior Art)】
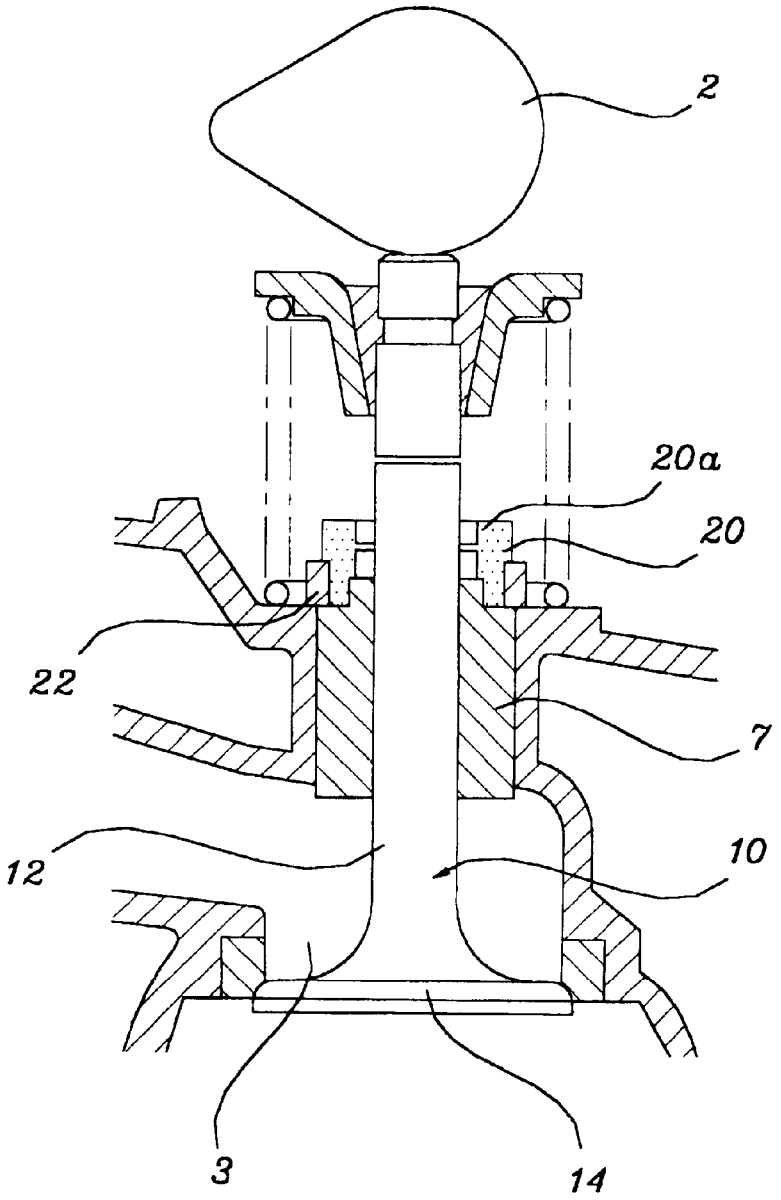

DEVICE FOR SENSING THE AMOUNT OF OIL IN OIL PANS

BACKGROUND OF THE INVENTION

1. Field of the Invention

The present invention relates, in general, to a valve stem sealing device used for preventing oil from entering a combustion chamber through a gap formed between a valve guide and a valve stem and, more particularly, to a valve stem sealing device with an oil seal being capable of rotation with the valve stem, thereby preventing the oil seal from being abraded and the oil from entering the combustion chamber.

2. Description of the Prior Art

As well known to those skilled in the art, an intake valve is mounted to an internal combustion engine, thus allowing a mixed fuel to flow into a combustion chamber. Also, the engine has an exhaust valve for exhausting combustion gas into the atmosphere.

FIG. 2 shows the construction of one typical valve, which may be an intake or an exhaust valve for internal combustion engines. It is important to note that the two valves are the same construction.

As shown in FIG. 2, a port 3 of a combustion chamber is opened or closed by the reciprocating motion of the valve which is driven by the rotating motion of a cam 2. The valve stem 12 of the valve 10 vertically reciprocates under the guide of a valve guide 7 of a cylinder head.

The cylinder head, with the cam 2, also has a valve control mechanism. In order to effectively operate both the cam 2 and the valve control mechanism, cooling and lubrication oil is supplied into the cylinder head.

However, the lubrication oil may be unexpectedly introduced into the combustion chamber through a gap formed between the valve guide 7 and the valve stem 12, thus reducing the combustion efficiency of the engine. Furthermore, such an unexpected introduction of oil into the combustion chamber may cause the engine to break down. Thus, it is preferable to mount an oil seal 20 onto the top of the valve guide 7 in an effort to prevent such an introduction of oil into the combustion chamber.

The oil seal 20 is fitted over the valve stem 12, with a support means 22 surrounding the seal 20 so as to hold the seal 20 in its place. The support means 22 is preferably made of a steel plate having a certain thickness. The support means 22 is fixed onto the top of the valve guide 7. The oil seal 20 has an annular blade 20*a*, which inwardly extends from the inner surface of the seal 20 and comes into close and movable contact with the side wall of the valve stem 12.

Thus, the oil seal 20 removes any gap from the junction between the valve guide 7 and the valve stem 12. That is, the valve stem 12 vertically reciprocates the inside of the oil seal 20, with the annular blade 20*a* being brought into close contact with the side wall of the valve stem 12, thereby preventing the oil from entering the combustion chamber.

When the valve 10 is reciprocally moved, the valve 10 is somewhat rotated. Also, in the operation of the valve, the valve head 14 comes into repeated contact with the port 3 at a high speed. As a result, the combustion chamber is repeatedly opened or closed by the reciprocating and rotating motion of the valve head 14.

However, in such a valve stem sealing device structure according to the prior art, the annular blade 20*a* of the oil seal 20 is quickly abraded due to the rotating motion of the valve 10, with the oil seal 20 being fixed to the top the valve guide 7 by the support means 22. Therefore, the typical sealing device may fail to prevent oil from flowing into the combustion chamber. In such a case, the sealing device reduces the combustion efficiency of an engine and, cause the engine to break down.

SUMMARY OF THE INVENTION

Accordingly, the present invention has been made in view of the above problems occurring in the prior art, and an object of the present invention is to provide a valve stem sealing device for engines, capable of rotating along with a valve stem, thereby not only preventing oil from unexpectedly entering a combustion chamber but also preventing the oil seal from being abraded, resulting in a reduction of oil consumption and an improvement in the combustion efficiency of an engine.

In order to accomplish the above object, the present invention provides a valve stem sealing device, comprising an annular oil seal surrounding a valve stem for preventing oil from entering a combustion chamber and an annular support member fixed to the top of a valve guide so as to hold said oil seal in its place, wherein said support member has an inwardly opening annular recess and rotatably receives said oil seal in said recess, with a bearing being positioned between said oil seal and the side wall of said support member.

BRIEF DESCRIPTION OF THE DRAWINGS

The above object, and other features and advantages of the present invention will be more clearly understood from the following detailed description taken in conjunction with the accompanying drawings, in which:

FIG. 1 is a cross-section view illustrating a valve stem sealing device in accordance with the preferred embodiment of the present invention; and FIG. 2 is a cross-section view illustrating a valve stem sealing device in accordance with the prior art.

DESCRIPTION OF THE PREFERRED EMBODIMENT

FIG. 1 shows the construction of a valve stem sealing device according to the preferred embodiment of this invention.

As shown in FIG. 1, the valve stem sealing device comprises a support member 66, oil seal 60 and needle bearing 64. The support member 66 includes an upper annular flange 66*b* inwardly extending from the end of a cylindrical side wall 66*a*, and a lower annular flange 66*c* inwardly extending from the central portion of the cylindrical side wall 66*a*. Also, the support member 66 has a recess opened toward a valve stem 52, with the recess being formed between the upper annular flange 66*b* and the lower annular flange 66*c*.

The oil seal 60 is rotatably inserted into the recess of the support member 66. The needle bearing 64 is positioned between the oil seal 60 and the cylindrical side wall 66*a*.

The oil seal 60 has an annular sharp blade 60*a*, which inwardly extends from the inner surface of the oil seal 60 and comes into contact with the valve stem 52. A support cap 62 covers the outside wall of the oil seal 60, with the top and bottom ends of the support cap 62 being inwardly bent, thus forming top and bottom annular flanges. The outside wall of the support cap 62 is brought into contact with the needle bearing 64. The top end of a valve guide 57 is fitted into the opening formed by both the side wall 66*a* and the lower annular flange 66*c* of the support member 66, with a rubber member 68 being tightly interposed between the support member 66 and the valve guide 57. Thus, the vibrations caused by the valve operation are absorbed by the rubber member 68.

The inner diameter of the oil seal 60 is smaller than that of either the flanges of the support member 66 or the support cap 62, thus allowing the seal 60 to come into close contact with the valve stem 52. Preferably, both the support member 66 and the support cap 62 are made of a certain thickness steel plate with a high durability and heat-resistance.

The operational effect of the device of this invention is described below.

A port 45, which may be an intake or an exhaust port, is opened or closed by the reciprocating motion of the valve according to the rotation of a cam 40, thereby allowing the piston in the cylinder to perform the continued stroke and generate the engine output power. In such an operation, the valve stem 52 is repeatedly and vertically moved under the guide of the valve guide 57, with the oil seal 60 being brought into close contact with the side wall of the valve stem 52. Thus, the device prevents oil from entering the combustion chamber through a gap formed between the valve guide 57 and the valve stem 52.

In the operation of the valve, the oil seal 60 is somewhat rotated along the valve stem 52 as it reciprocates. That is, because the needle bearing 64 is interposed between the support cap 62 and the support member 66, the oil seal 60 with the support cap 62 is rotated along the valve stem 52 irrespective of the support member 66 being fixed to the top of the valve guide 57.

During the reciprocating motion of the valve 50, the vibrations, which are transmitted to the valve guide 57 or the oil seal 60, are effectively absorbed by the rubber member 68 positioned between the support member 66 and the valve guide 57.

As mentioned above, the valve stem sealing device in accordance with the present invention has the oil seal 60, which is rotatable along with the valve stem 52 due to the needle bearing 64 during the reciprocating motion of the valve 50. Therefore, the abrasion of the oil seal is minimized, thus remarkably improving the oil sealing effect.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A valve stem sealing device for preventing oil from entering a combustion chamber, the valve stem sealing device comprising:

an annular oil seal surrounding the valve stem;

an upper annular flange;

a lower annular flange, wherein the upper annular flange and the lower annular flange hold said oil seal in place;

a valve guide which guides the valve stem;

an annular support member fixed to a top of the valve guide so as to hold the oil seal in position, wherein the annular support member has an inwardly opening annular recess that rotatably receives the oil seal; and a bearing which allows the oil seal to rotate with respect to the annular support member, wherein the bearing is positioned between the annular oil seal and the cylindrical side wall of said support member so as to quicken the rotation of said oil seal along said valve stem during reciprocating motion of said valve stem so as to minimize abrasion of said oil seal as said seal wipes said valve stem.

2. The valve stem sealing device as claimed in claim 1, wherein a rubber member is tightly interposed between said support member and said valve guide so as to absorb the vibrations caused by a valve operation.

3. The valve stem sealing device as claimed in claim 1, wherein a support cap covers the outside wall of said oil seal so that the outside wall of said support cap is brought into contact with said bearing.

4. The valve stem sealing device as claimed in claim 3, wherein the support cap has top and bottom ends inwardly bent so as to form top and bottom annular flanges.

5. The valve stem sealing device as claimed in claim 4, wherein the oil seal has an inner diameter smaller either the flanges of the support cap or the recess formed by the support member, thereby allowing the seal to come into close contact with the valve stem.

6. The valve stem sealing device as claimed in claim 3, wherein both the support member and the support cap are comprised of steel plate.

7. The valve stem sealing device as claimed in claim 1, wherein the oil seal has an annular sharp blade which inwardly extends from an inner surface of the oil seal and comes into contact with the valve stem.

8. The valve stem sealing device as claimed in claim 1, wherein the bearing is a needle bearing.

* * * * *

UNITED STATES PATENT AND TRADEMARK OFFICE

CERTIFICATE OF CORRECTION

PATENT NO. : 6,006,778

DATED : December 28, 1999

INVENTOR(S) : Kim

It is certified that error appears in the above-identified patent and that said Letters Patent is hereby corrected as shown below:

On the title page:

In item "[54]" please correct the title from "DEVICE FOR SENSING THE AMOUNT OF OIL IN OIL PANS" to – SEALING DEVICE FOR VALVE STEM IN INTERNAL COMBUSTION ENGINES –.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*